United States Patent [19]

Carr

[11] Patent Number: 4,638,717

[45] Date of Patent: Jan. 27, 1987

[54] COMBINATION OF CUSHION, ADJUSTER AND SIDE PORTS IN A SINGLE UNIT ROTARY ACTUATOR

[75] Inventor: Paul Carr, Massillon, Ohio

[73] Assignee: Flo-Tork, Inc., Orrville, Ohio

[21] Appl. No.: 697,345

[22] Filed: Feb. 1, 1985

[51] Int. Cl.[4] ..... F15B 15/22; F15B 15/24

[52] U.S. Cl. ..... 91/26; 91/395; 91/396; 92/13.6; 92/85 B

[58] Field of Search ..... 91/395, 396, 394, 25, 91/26; 92/13.6, 13, 85 B

[56] References Cited

U.S. PATENT DOCUMENTS

| | | | |
|---|---|---|---|
| 2,222,819 | 11/1940 | Light | 91/396 |
| 2,761,424 | 9/1956 | Hopkins | 91/396 |
| 2,882,869 | 4/1959 | Krapf | 91/396 |
| 3,213,760 | 10/1965 | Carr | 91/26 |
| 3,626,807 | 12/1971 | Shartzer | 91/39 X |

*Primary Examiner*—Robert E. Garrett
*Assistant Examiner*—Mark A. Williamson
*Attorney, Agent, or Firm*—Oldham, Oldham & Weber Co.

[57] ABSTRACT

A rotary actuator having a piston travel adjustment mechanism and a cushioning mechanism associated in a single attached unit, with side porting for fluid pressure, thus having a more compact structure that is lighter in weight and yet completely adjustable.

9 Claims, 1 Drawing Figure

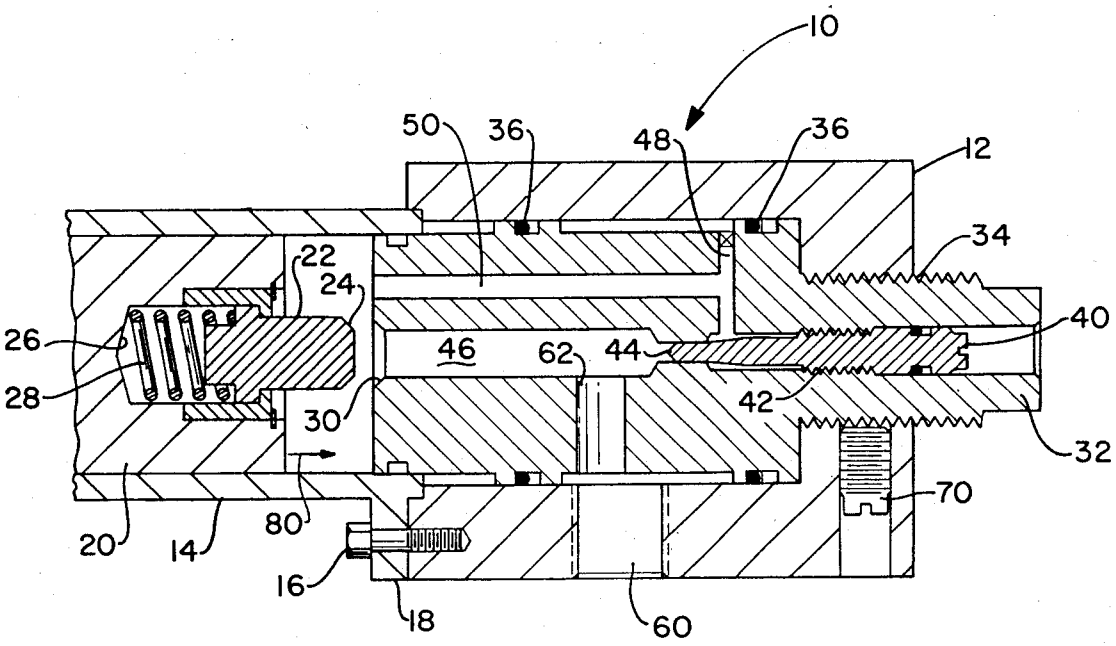
10
12
14
16
18
20
22
24
26
28
30
32
34
36
36
40
42
44
46
48
50
60
62
70
80

COMBINATION OF CUSHION, ADJUSTER AND SIDE PORTS IN A SINGLE UNIT ROTARY ACTUATOR

TECHNICAL FIELD

This invention relates primarily to the field of rotary actuators, these being fluid-driven units to translate linear motion into rotary motion. Essentially, the rotary motion is accomplished by applying fluid pressure to a cylinder piston which drives a linear gear rack. The gear rack then drives the pinion gear mated to it, imparting rotary motion to the pinion shaft. The pinion shaft is mounted between two support bearings and is connected to the load, either directly, through a coupling, or by linkage. Rotary actuators are known to provide economical, energy-efficient power converters for countless applications and permit high speed operation with controlled acceleration and deceleration.

BACKGROUND ART

Heretofore there have been various types of rotary actuators and particularly these actuators have incorporated some type of adjustment to the length of the linear stroke, and perhaps some type of cushioning to absorb deceleration forces simply and economically over the last 15 degrees of rotation. Traditionally, these features are independent and utilize an independent structure associated with them to appropriately perform their respective functions. In addition, the fluid piping associated with these two functions has traditionally been aligned with the end of the linear motion, thus providing the need for more space in connection with the rotary actuating package.

U.S. Pat. No. 3,213,760 shows the fluid cushion arrangement which I invented previously. In this construction, the adjustment screw 31 is associated at a 90 degree angle with respect to the linear motion of the rack, and this construction does not provide adjustability in the length of the stroke of the rack.

DISCLOSURE OF INVENTION

It is the general object of the present invention to provide a new and improved combined adjustable control of the rotation stroke, an adjustable cushion control, and side porting to save space, and which arrangement has a reduced number of parts in relation to prior art structures, and which new unit is capable of being made at much less cost and which unit is stronger and more durable than the prior art construction.

Another object of the invention is to add the fluid porting to the side of the adjustable rotation stroke control so as to eliminate the need for plumbing extending in line with the linear motion of the rack, thus enabling the structure to utilize less space.

A further object of the invention is to combine the adjustability and cushion control in one mechanism that is bolted to the end of the actuator, thus allowing a simplistic modification of the rotary actuator by the mounting of the cylinder head to the end of the cylinder tube.

The aforesaid and other objects of the invention are achieved by providing an independent cylinder head mechanism directly attachable to the cylinder tube of a rotary actuator which is characterized by: incorporating an adjustable stroke piston control into the cylinder head, a needle cushion adjuster threadably received in the adjuster piston, and side porting for fluid pressure through the cylinder head into the adjuster piston.

BRIEF DESCRIPTION OF DRAWINGS

Reference is now particularly directed to the accompanying drawing which is a broken-away cross-sectional elevational view in assembly of the structure comprising a preferred embodiment of the invention showing the unitary arrangement of the cushioning and stroke adjuster mechanism attached to the end of the cylinder tube of a rotary actuator and with side porting of the fluid pressure through the cylinder head.

BEST MODE FOR CARRYING OUT THE INVENTION

For a better understanding of the invention, reference should be made to the drawing wherein the numeral 10 indicates generally the adjuster and cushioning mechanism of the invention with the side porting, this comprising a cylinder head 12 which is attached to a cylinder tube 14, preferably by being bolted in relationship thereto, as shown by bolt 16 passing through flange 18 that is integral with cylinder tube 14, and with the bolt being firmly secured in threadable engagement into the actuator body 12 as indicated.

A pressure piston is indicated by numeral 20 that slides inside the cylinder tube 14 and contains an association with an end thereof, a cushion pin 22 having a tapered nose 24, with the pin 22 being spring-loaded into cavity 26 by a spring 28. This cushion structure is essentially the same as in my prior U.S. Pat. No. 3,213,760 and is contemplated to perform the same function as taught therein; namely, to provide a cushioning commencing about 15 degrees before the end of the travel of the rack.

The cushion control is accomplished by the cushion nose 24 cooperating with a tapered adjuster seat 30 formed in the end of the adjuster piston 32. The adjuster piston 32 is threadably received through the end of the cylinder head 12 as shown at 34 and contains O sealing rings 36 so that it may slide within the head and thus lengthen or shorten the movement of the piston 20 by the amount of threadable movement 34 of the adjuster piston 32 with respect to the cylinder head 12.

The cushioning is accomplished by a needle adjuster 40 that is threadably received into the adjuster 32 at the threadable section 42, with a needle point 44 that is received into the reduced diameter portion of the adjuster opening 46 associated with the adjuster seat 30. Appropriate porting around the needle point 44 through port 48 and 50 completes the fluid passage to achieve the cushioning effect desired.

Side porting is accomplished through side port 60 through the cylinder head 12 which cooperates through a respective port 62 in the adjuster 32 for communications with passage 46 to provide the primary air or hydraulic fluid necessary.

The structure is completed by a locking screw 70 that locks the adjuster 32 in position at the desired location.

Hence, in operation, it should be understood that as the piston 20 moves in the direction of arrow 80, the cushion nose 24 seats into the adjuster seat 30 and seals off any further release of hydraulic fluid through port 46 and out port 62 and port 60 into the hydraulic system. Once this occurs, the fluid must then pass through port 50, passage 48 around the needle tip 44 and then into passage 46 and out ports 60 and 62. Naturally, the restriction caused by needle 44 at its appropriate adjusted position is what achieves the cushioning action desired in this system. The length of the travel of piston 20 in the direction 80 is obviously accomplished by the actual positioning of the adjuster 32 depending upon how far it has been screwed into or out of its sliding relationship inside the cylinder tube 14.

It is an important aspect of this invention that the porting 60 be on the side so that all piping necessary with the appropriate fluid pressure system does not protrude from the end of the adjuster 32, and this provides for a more compact and smaller package.

Thus, in summary, the invention is a combination of the features used on the cylinder heads of rotary actuators wherein the adjuster 32 is normally a screw type device which is used to shorten the rotation or allow the actuator t rotate to its full limits. However, due to the incorporation of adjustable flow cushions being combined into this design an adjustable orifice to control the cushion flow by utilizing the metering needle 40 is installed into the adjuster piston 32 along with the required fluid passages to meter the fluid from the cylinder after the cushion nose has stopped the flow from the actuator cylinder. The lock screw 70 is provided for locking the adjuster in place once the desired rotative movement of the rotary actuator is selected, although it should be understood that there could be adjustable control to both the needle 40 and the adjuster 32 by other rotary actuators if that were desirable. The side port connection through port 60 is provided in the cylinder head itself to plum the hydraulic flow to pressurize the piston 20 of the rotary actuator in the usual manner.

It should be further understood that this structure can be mounted to an existing actuator with a minimal or no modification or adaptation. One assembly can be used for one direction or two may be used for control of both directions of movement. It is very simple and compact to combine the dual functions into a single housing while still having the side mounting for the hydraulic or fluid system.

While in accordance with the patent statutes, only a preferred embodiment has been illustrated and described in detail, it is to be particularly understood that the invention is not limited thereto or thereby, but the inventive scope is defined in the appended claims.

What is claimed is:

1. A fluid controlled actuator including a housing defining a first cylinder with a linear moving driving piston therein which is characterized by:

a separate cylinder head fixedly defining a second cylinder and attached to the housing with the respective cylinders in alignment;

an adjuster piston slidably received in the aligned cylinders;

means to control and lock the linear position of the adjuster pistion at a desired location within the aligned cylinders, thus limiting the length of travel of the driving piston;

means to provide cushioning of the termination of the driving piston stroke by mechanism associated with the respective pistons themselves, said means comprising a spring pressed pin reciprocable in a cavity in said driving piston and projecting beyond the end thereof, a first passage in said adjuster piston in axial alignment with said pin, said first passage being normally open at the inner end of said adjuster piston and being closed by said pin as said driving piston approaches the forward end of its travel, second passage means extending through said adjuster piston from the inner end thereof to said first passage means, and an adjustable needle in said adjuster piston for restricting the flow of fluid through said second passage means;

a first side port extending through the cylinder head in a direction transverse to the direction of piston movement to provide fluid pressure to said driving piston; and a second side port extending transversely through the adjuster piston and communicating with said first passage means and said first side port.

2. A fluid actuator according to claim 1 in which the forward end of said pin has a tapered nose and the inner end of said adjuster piston has a tapered seat surrounding said first passage and cooperating with said tapered nose.

3. A fluid actuator according to claim 1 in which said needle is axially aligned with said first passage.

4. A fluid actuator according to claim 1 in which said adjuster piston has a portion of reduced outside diameter, said portion providing an annular chamber which is in communication with said first and second such ports in all positions of said adjuster piston.

5. A fluid actuator according to claim 1 in which said cylinder head, said adjuster piston and said first passage in said adjuster piston extend axially beyond the end of said first cylinder and said first and second side ports are disposed beyond the end of said first cylinder.

6. A fluid actuator according to claim 5 in which said adjuster piston extends beyond the end of said cylinder head.

7. A fluid actuator according to claim 1 including sealing means between said adjuster piston and said cylinder head.

8. A fluid actuator according to claim 7 in which said sealing means include sealing rings on either side of said second port.

9. A mechanism for adjusting the length of stroke of a reciprocating piston and for cushioning said piston, said mechanism comprising:

a housing defining a first cylinder in which said piston reciprocates;

a separate cylinder head fixedly defining a second cylinder and attached to said housing with the respective cylinders in alignment;

an adjuster piston slidably received in the aligned cylinders;

means to control and lock the linear position of the adjuster piston at a desired location within the aligned cylinders, thus limiting the length of travel of the driving piston;

means to provide cushioning of the termination of the driving piston stroke by mechanism associated with the respective pistons themselves, said means comprising a spring pressed pin reciprocable in a cavity in said driving piston and projecting beyond the end thereof, a first passage in said adjuster piston in axial alignment with said pin, said first passage being normally open at the inner end of said adjuster piston and being closed by said pin as said driving piston approaches the forward end of its travel, second passage means extending through said adjuster piston from the inner end thereof to said first passage means, and an adjustable needle in said adjuster piston for restricting the flow of fluid through said second passage means;

a first side port extending through the cylinder head in a direction transverse to the direction of piston movement to provide fluid pressure to said driving piston; and a second side port extending transversely through the adjuster piston and communicating with said first passage means and said first side port.

* * * * *